United States Patent [19]

Keeffe et al.

[11] 4,044,276

[45] Aug. 23, 1977

[54] HIGH PRESSURE MERCURY VAPOR DISCHARGE LAMP HAVING IMPROVED ELECTRODES

[75] Inventors: William M. Keeffe, Rockport, Mass.; Frederic Koury, Alexandria, N.H.

[73] Assignee: GTE Sylvania Incorporated, Danvers, Mass.

[21] Appl. No.: 675,433

[22] Filed: Apr. 9, 1976

[51] Int. Cl.[2] ..... H01J 17/04; H01J 61/06

[52] U.S. Cl. ..... 313/218; 313/311; 313/346 R

[58] Field of Search ..... 313/346, 311, 218

[56] References Cited

U.S. PATENT DOCUMENTS

| | | | |
|---|---|---|---|
| 2,687,489 | 8/1954 | Anderson, Jr. et al. | 313/346 R |
| 2,843,801 | 7/1958 | Krefft | 313/184 X |
| 3,134,924 | 5/1964 | Henderson et al. | 313/346 R |
| 3,249,788 | 5/1966 | Wainio et al. | 313/346 R |
| 3,656,020 | 4/1972 | Cronin | 313/311 |
| 3,742,282 | 6/1973 | Siegle | 313/311 |
| 3,886,391 | 5/1975 | Koury et al. | 313/218 |
| 3,922,428 | 11/1975 | Cronin | 313/346 R |

*Primary Examiner*—Saxfield Chatmon, Jr.
*Attorney, Agent, or Firm*—James Theodosopoulos

[57] ABSTRACT

The emitter material on the electrode of a high intensity discharge lamp comprises hafnium oxide, barium oxide and calcium oxide.

3 Claims, 2 Drawing Figures

HIGH PRESSURE MERCURY VAPOR DISCHARGE LAMP HAVING IMPROVED ELECTRODES

THE INVENTION

This invention concerns high pressure mercury vapor (HPMV) arc discharge lamps and especially the electrodes therefor. Such lamps comprise an elongated glass arc tube having a main electrode at each end and containing a fill of mercury and a starting gas, the mercury pressure during normal operation being greater than about one atmosphere. An example of such a lamp is shown in U.S. Pat. No. 3,064,157.

In a lamp in accordance with this invention, the electrodes thereof contain an electron-emitting material comprising hafnium oxide, barium oxide and calcium oxide.

The prior art discloses that hafnium oxide is an electron-emitting material. See, for example, U.S. Pat. No. 2,843,801, column 1, lines 53–59. However, previous attempts to use hafnium oxide in HPMV lamps have been unsuccessful due to short life because of high operating temperature. We have found that hafnium oxide can be satisfactorily used as an electrode composition in a high pressure mercury vapor arc discharge lamp provided it is admixed with barium oxide and calcium oxide within a certain range and provided that the refractory metal electrode temperature is maintained within a specified range during normal lamp operation. The hot spot electrode temperature during normal lamp operation must be between about 1200° and 1700° C. The hafnium oxide content of the composition must be between about 1/6 to ⅔ of the total weight thereof. Below about a sixth, the lamp maintenance suffers and the starting voltage increases. Above about two-thirds, the lamp maintenance suffers.

Figure 1:
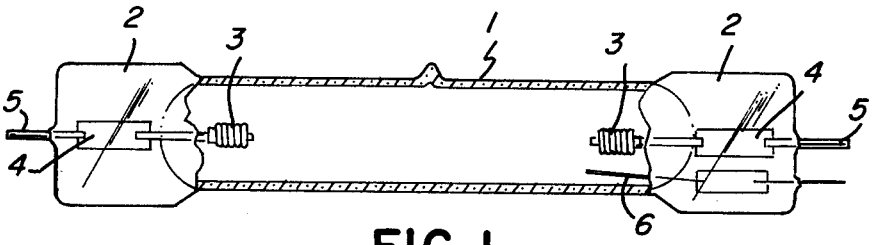
FIG. 1 is an elevational view of an HPMV arc tube in accordance with this invention.

As shown in FIG. 1, one embodiment of an HPMV lamp in accordance with this invention comprises an arc tube 1 made of high silica glass, for example, quartz, having press seals 2 at each end thereof. At each end of arc tube 1 is an electrode 3 which is connected to a molybdenum ribbon 4 which is connected, in turn, to external lead-in wire 5. The arc tube has a starting electrode 6 as is known in the art. The electron-emitting composition of this invention is disposed on each electrode 3.

Figure 2:
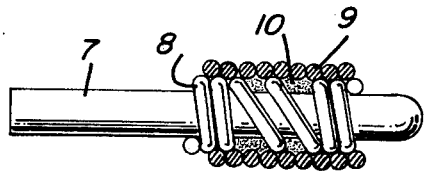
FIG. 2 is an expanded sectional view of an HPMV electrode.

In one embodiment of electrode 3, as shown in FIG. 2, the electrode comprises a tungsten rod 7 having inner tungsten coil 8 thereon encircling a portion of rod 7 and secured thereto. Outer tungsten coil 9 is threaded on coil 8. The emitting material 10 of this invention is disposed in the recesses between coils 8 and 9. Coil 8 may have some open turns, as shown in FIG. 2, in order to accommodate more emitting material 10.

Emitting material 10 was prepared by blending 200 grams of a barium carbonate and calcium carbonate mixture (85 weight percent $BaCO_3$, 15 weight percent $CaCO_3$) with 100 grams of hafnium dioxide in 170 milliliters of methanol. As is known, calcium oxide is used to lower the volatility of the barium oxide. The mixture was ball milled for 17 hours following which the specific gravity was adjusted to 1.675 by the addition of methanol. The electrodes were coated with this mixture, dried and then dry hydrogen fired for 15 minutes at 1500° C, decomposing the carbonates into the oxides. The electrodes were then sealed into arc tube 1 which was then completed into a finished lamp.

In 400 watt HPMV lamps, a comparison was made between the emitter material of this invention with the emitter material that has generally been used, which is a mixture of barium, calcium and thorium oxides as disclosed in British Pat. No. 577,599. Both in lamp starting voltage and in lumen maintenance, the emitter coating of this invention was better. At lamp operating durations of 100 hours 500 hours and 2000 hours, the starting voltages were 123 volts, 124 volts and 125 volts respectively for the old emitter coating and 121 volts, 113 volts and 110 volts for the emitter coating of this invention. Lumen maintenance at 2000 hours was 98% for the old emitter coating and 100% for the emitter coating of this invention.

We claim:

1. In a high pressure mercury vapor arc discharge tube having a main electrode at each end thereof and containing a fill including mercury and a starting gas, the improvement which comprises an electron-emitting material on the electrodes comprising barium oxide, calcium oxide and hafnium oxide, the hafnium oxide constituting about 1/6 to ⅔ by weight of said material, the electrode temperature during normal lamp operation being between about 1200° and 1700° C.

2. The lamp of claim 1 wherein the electrode comprises a tungsten rod having two concentric encircling tungsten coils thereon and said material is disposed between said two coils.

3. For use in a high intensity arc discharge lamp, an electron-emitting composition disposed on a refractory metal electrode and consisting essentially of hafnium oxide, barium oxide and calcium oxide.

* * * * *